US008852018B1

(12) United States Patent
Hanley

(10) Patent No.: US 8,852,018 B1
(45) Date of Patent: Oct. 7, 2014

(54) METHOD AND DEVICE FOR RETRIEVING A GOLF BALL

(76) Inventor: James Hanley, Parsippany, NJ (US)

( * ) Notice: Subject to any disclaimer, the term of this patent is extended or adjusted under 35 U.S.C. 154(b) by 286 days.

(21) Appl. No.: 13/334,505

(22) Filed: Dec. 22, 2011

(51) Int. Cl.
*A63B 47/02* (2006.01)

(52) U.S. Cl.
USPC ..... 473/286; 294/19.2

(58) Field of Classification Search
CPC ..... A63B 47/02; A63B 2047/02
USPC ..... 473/286; 294/19.2
See application file for complete search history.

(56) References Cited

U.S. PATENT DOCUMENTS

| | | | | |
|---|---|---|---|---|
| 3,401,970 | A * | 9/1968 | Russell | 294/19.2 |
| 3,669,427 | A | 6/1972 | Curtis | |
| 3,749,407 | A | 7/1973 | Prochnow | |
| 5,460,366 | A | 10/1995 | Pugh | |
| 5,690,558 | A | 11/1997 | Huber | |
| 5,782,704 | A * | 7/1998 | Tetler et al. | 473/282 |
| 5,829,806 | A | 11/1998 | Sykes | |
| 8,272,612 | B2 * | 9/2012 | Thorpe | 248/316.7 |
| 8,523,699 | B2 * | 9/2013 | Bennett | 473/286 |
| 2006/0264267 | A1 * | 11/2006 | Fox | 473/300 |
| 2007/0049396 | A1 | 3/2007 | Scheibe | |
| 2008/0261714 | A1 * | 10/2008 | Bae | 473/286 |
| 2011/0053701 | A1 | 3/2011 | Eddings | |

FOREIGN PATENT DOCUMENTS

WO WO 0045901 A1 * 8/2000

* cited by examiner

*Primary Examiner* — Stephen L. Blau

(57) ABSTRACT

A method for retrieving a golf ball employs a gripper with a magnetic coupling. The coupling has a cavity containing a magnet. The magnet has a field strength adequate to hold onto a vertical surface of an unmagnetized metal object while a golf ball is held in the gripper. The magnetic coupling is magnetically attached a non-magnetized head of a golf club. In operation, downward force is applied through the golf club to depress the magnetic coupling in order to encompass and grip the golf ball with the gripper. The head of the club is lifted and the golf ball removed from the gripper. The device can be stored by clipping it to an object.

13 Claims, 8 Drawing Sheets

METHOD AND DEVICE FOR RETRIEVING A GOLF BALL

BACKGROUND OF THE INVENTION

1. Field of the Invention

The present invention relates to golf ball retrieval, and in particular, to magnetic attachment of devices onto a golf club.

2. Description of Related Art

In the game of golf, a golfer often has to retrieve a golf ball from a playing surface or from a putting cup. This requires the golfer to bend from the waist with hand outstretched. Since back problems are common in the general population, regularly bending over to retrieve a golf ball can cause discomfort, pain, or even injury to the lower back. Problems can arise with the shoulder as well. These problems are often worse for elderly or handicapped golfers who may actually be unable to bend over sufficiently to retrieve a golf ball. Even a golfer without physical limitations can become fatigued toward the end of a round of golf and may find bending over for ball retrieval tedious.

Some golfers will carry a pole with a scoop on the distal end for retrieving a golf ball. In some cases, these ball retrievers are designed to retrieve a ball that has fallen into a water trap. However, carrying a pole dedicated to retrieving golf balls adds to the overall weight of a golf bag packed with clubs, balls and various other accessories.

Known devices are designed to be attached to a golf club where they can be used for retrieving a golf ball. Some of these devices require modification of the golf club to accomplish the attachment of the ball retriever. However, golfers are very reluctant to modify their golf clubs for fear of impairing the club performance due to weight imbalance, induced vibrations, etc. Moreover, fine golf clubs are very carefully crafted and would not be supplied with non-critical features simply to accommodate attachment of subsidiary accessories.

See also, U.S. Pat. Nos. 3,401,970; 3,669,427; 3,749,407; 5,460,366; 5,690,558; and 5,829,806, as well as US Patent Application Publication Nos. 2007/0049396; 2008/0261714; and 2011/0053701.

SUMMARY OF THE INVENTION

In accordance with the illustrative embodiments demonstrating features and advantages of the present invention, there is provided a method for retrieving a golf ball, employing a gripper with a magnetic coupling. The method includes the step of magnetically attaching the magnetic coupling to a non-magnetized head of a golf club. The method also includes the step of applying a downward force through the golf club to depress the magnetic coupling in order to encompass and grip the golf ball with the gripper. Also included is the step of lifting the head of the club and removing the golf ball from the gripper.

In accordance with another aspect of the invention, there is provided a golf ball retriever including a coupling and a gripper for holding a golf ball. The coupling is attached to the gripper and has a cavity containing a magnet. The magnet has a field strength adequate to hold onto a vertical surface of an unmagnetized metal object with the gripper holding a golf ball therein.

In accordance with yet another aspect of the invention, a method is provided for retrieving a golf ball. The method employs a gripper with a magnetic coupling. The method includes the step of inverting a golf club with the underside of its head oriented up. The method also includes the step of magnetically attaching the magnetic coupling on the underside of the head of the golf club by placing the magnetic coupling against a portion of the head that is a non-magnetized, ferromagnetic metal. Also included is the step of reorienting the golf club and applying a downward force through the golf club to depress the magnetic coupling and deform at least a portion of the gripper in order to encompass and grip the golf ball with the gripper. The method includes the step of lifting the head of the club and removing the golf ball from the gripper. The method also includes the step of removing the magnetic coupling from the head of the golf club. Also included is the step of storing the magnetic coupling and the gripper by clipping one of them to an object.

By employing methods and apparatus of the foregoing type, an improved technique for retrieving golf balls is achieved. In a disclosed embodiment a magnetic coupling supports a gripper. The field strength of the magnet is sufficient to hold the gripper on the head of an ordinary golf club. The disclosed magnet will not be readily dislodged from the club head when the gripper has seized and then lifted a golf ball.

In one embodiment the magnetic coupling is a cylindrical collar that holds a magnetic disk flush with the distal end of the collar. The proximal end of the collar provides a cavity for holding the stem of a disclosed gripper. A clip is tethered on an eyelet formed on this collar and can be used to clip the device to an article of clothing or a golf bag.

A variety of grippers are disclosed. One gripper has a pair of trapezoidal loops crowned with semicylindrical stubs (or other prongs) that can be joined together and inserted into the previously mentioned collar of the magnetic coupling. Another gripper has a pair of U-shaped elements that are joined together at their bases and fitted with stretchable elements that are strung through tips of the elements. Yet another gripper has an opposing pair of shells that can be spread apart in order to clamp around a golf ball. Another gripper is cup-shaped and a stretchable element strung through its rim is used to hold a golf ball.

Still yet another gripper has a stool-like configuration with a trio of springy legs that are urged together by a stretchable element that is strung through the tips of the legs. The golf ball can be held between the legs, which have on their tips inwardly directed lips for capturing the ball.

Another gripper has a pair of opposing plates with lips that turn inwardly to grip a golf ball. The ball is further captured between these plates by an opposing pair of stops lying on a plane between the plates.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
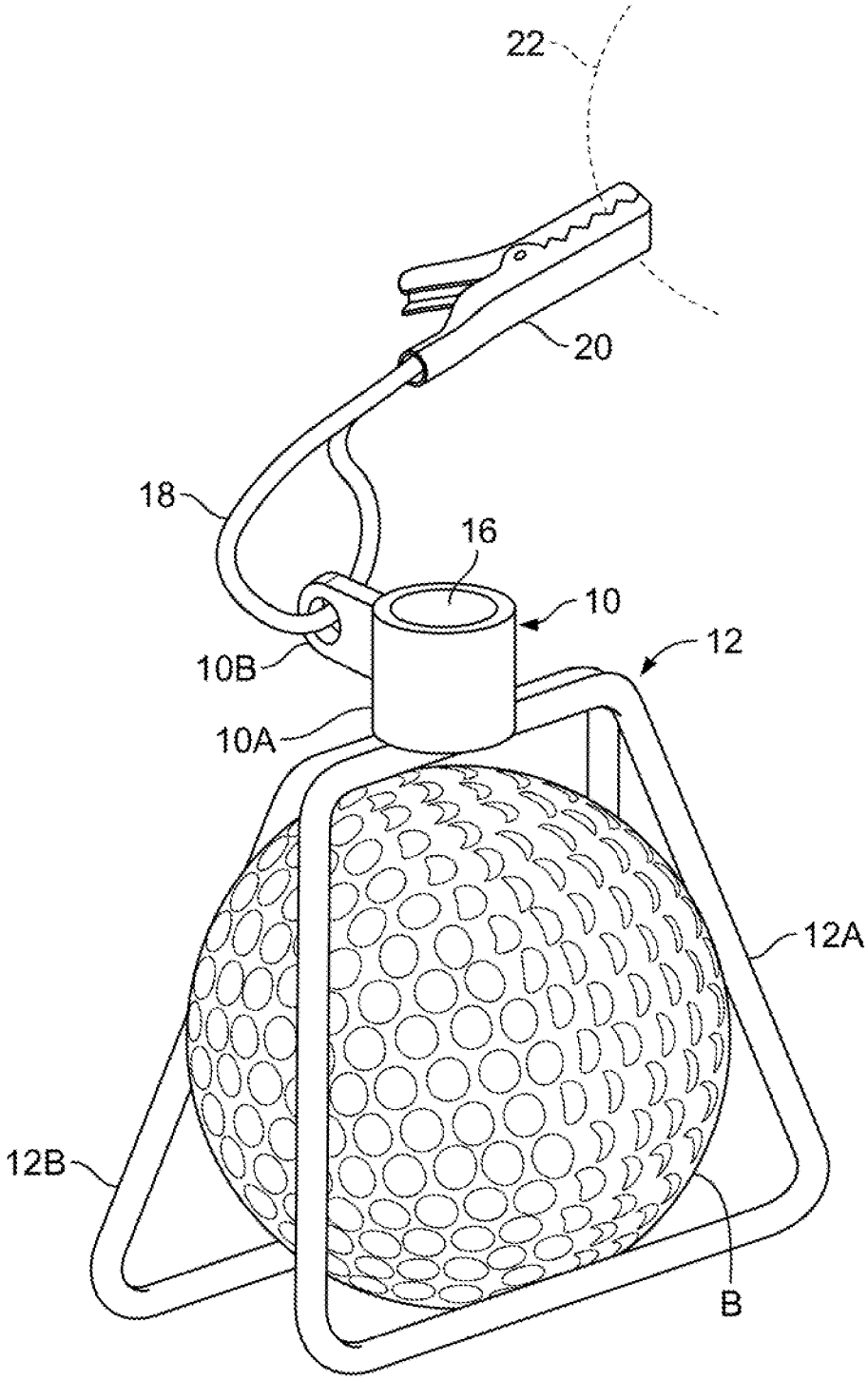
FIG. 1 is a perspective view of a golf ball retriever exemplifying apparatus and methods in accordance with principles of present invention.
Figure 2:
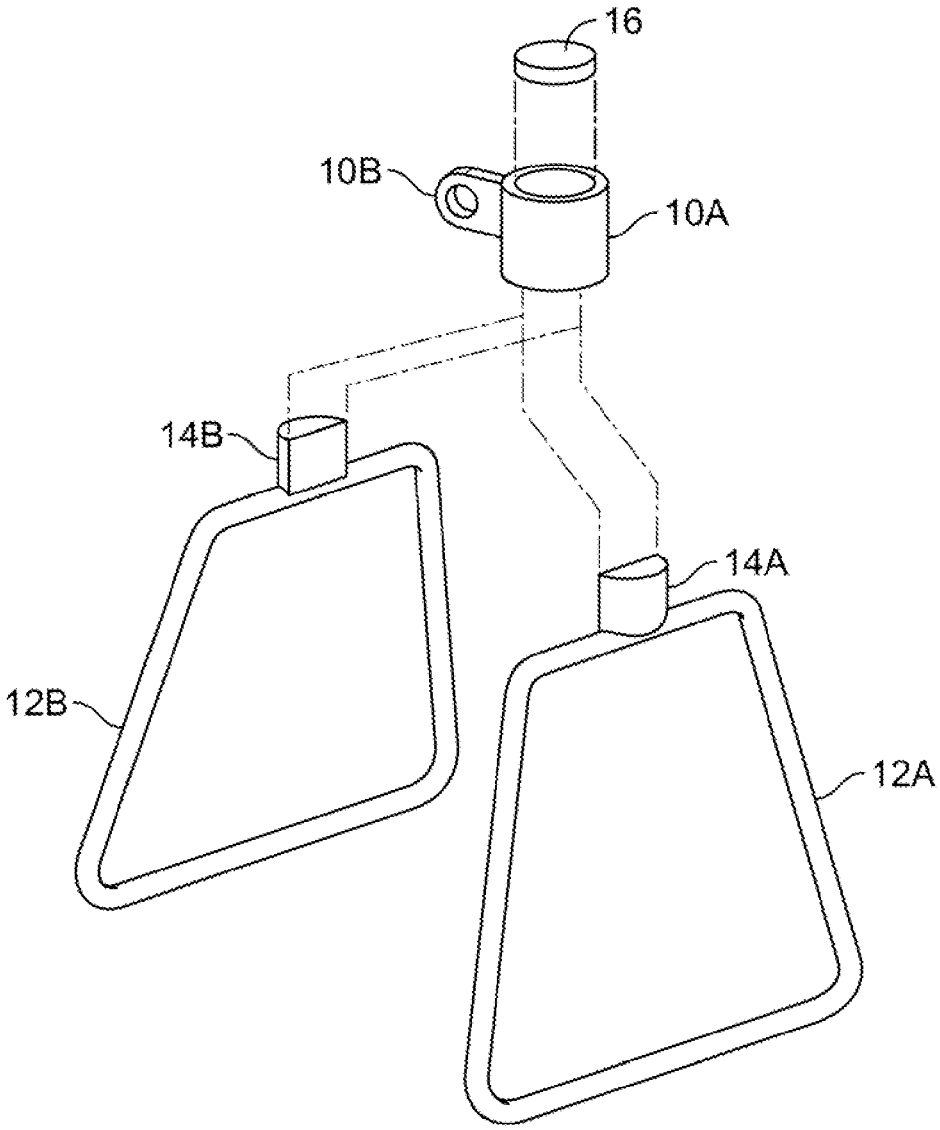
FIG. 2 is an exploded view of the retriever of FIG. 1.

Referring to FIGS. 1 and 2 a golf ball retriever is shown with a magnetic coupling 10 attached at the joint between trapezoidal loops 12A and 12B of gripper 12. Loops 12A and 12B each have four integral branches, namely, a distal transverse branch that connects through two converging side branches to a transverse proximal branch. Loops 12A and 12B may be made of injection molded plastic, although in other embodiments they may be made of metal, wire coated with an elastomer, etc.

Mounted on the proximal branch of loops 12A and 12B are semicylindrical stubs 14A and 14B, respectively. Stubs 14A and 14B can be joined together to form a cylindrical stem that is inserted into cylindrical collar 10A and secured in place by glue, heat sealing, crimping, pinning, or other fastening means. Stem 14A/14B does not fill collar 10A completely but leaves open a cavity for receiving magnet 16, which can be secured by gluing or other fastening means. Collar 10A is metallic (e.g. steel) in this embodiment although other embodiments may use different materials such as plastic.

Eyelet 10B is shown as a tab that projects radially from the side of collar 10A. Tether 18 is shown as a cord that loops through eyelet 10B and is crimped into a proximal tubular socket in alligator clip 20, whose jaws are shown gripping an object 22.

In this embodiment the branches of loops 12A and 12B have a diameter of 5/32 inch (4 mm) and form an inside perimeter that is sized to grip a golf ball. The disclosed inside perimeter is 1 9/16 inches (4 cm) wide at the distal end and 1 1/8 inches (2.9 cm) wide at the proximal end, while the inside distance from the proximal to distal end is 1 11/16 inches (4.3 cm). Loops 12A and 12B lie in diverging planes and have a 1 inch (2.5 cm) separation at their distal ends. It will be understood that the foregoing dimensions are exemplary and that different dimensions can be used in other embodiments. Also, in some embodiments, loops 12A and 12B may have a different configuration and may have an outline that is circular, oval, triangular, polygonal etc.

Figure 3:
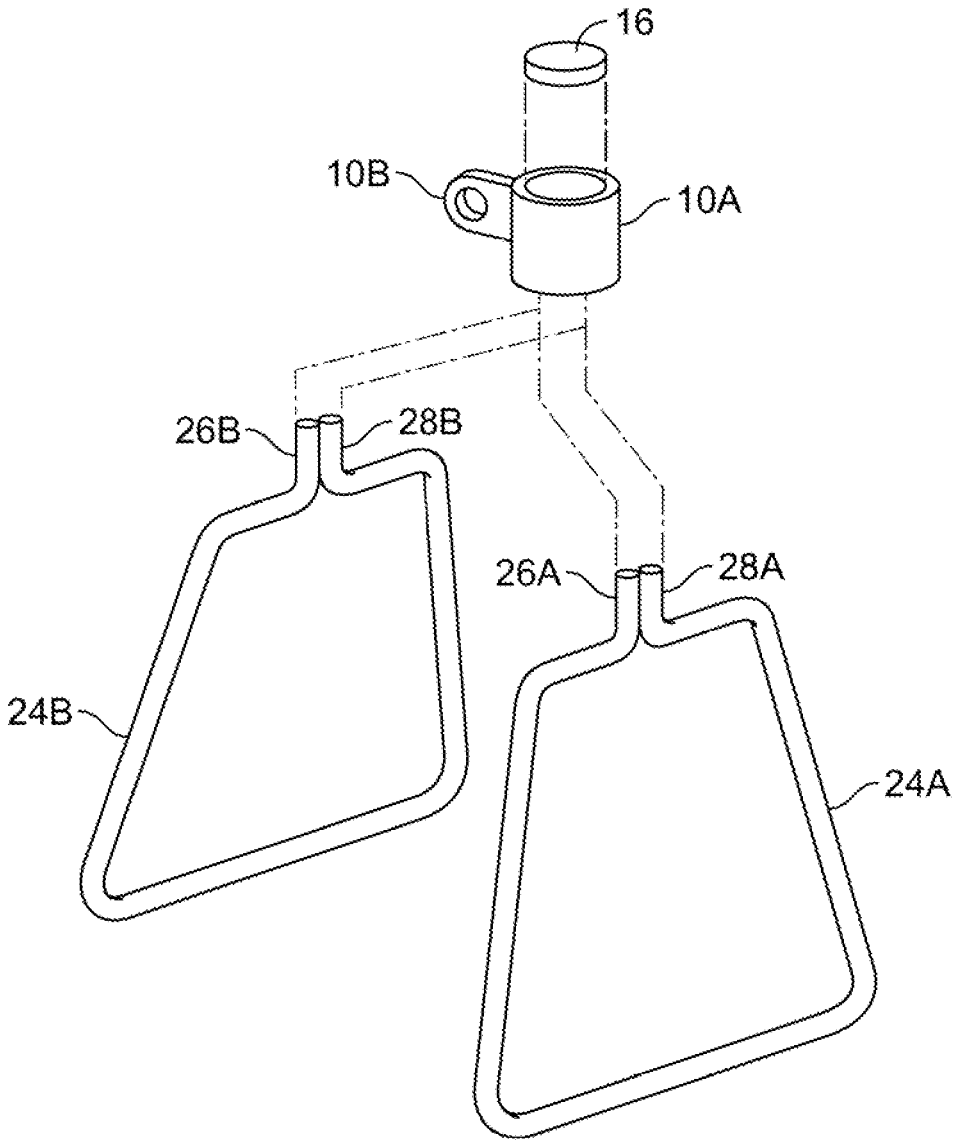
FIG. 3 is an exploded of a retriever that is an alternate to that of FIG. 2.

Referring to FIG. 3, an alternate gripper is formed of trapezoidal loops 24A and 24B, which are the same as the previously mentioned gripper 12, except for the configuration of the proximal branch of the loops. The center of the proximal branch of loop 24A has a pair of ends 26A and 28A that turn away and form a pair of contiguous parallel stubs. Likewise, the proximal branch of loop 24B has a pair of ends 26B and 28B that also turn away and form a pair of contiguous parallel stubs. The stubs 26A, 28A, 26B and 28B are brought together to form a stem that is fastened inside previously mentioned collar 10A.

Figure 4:
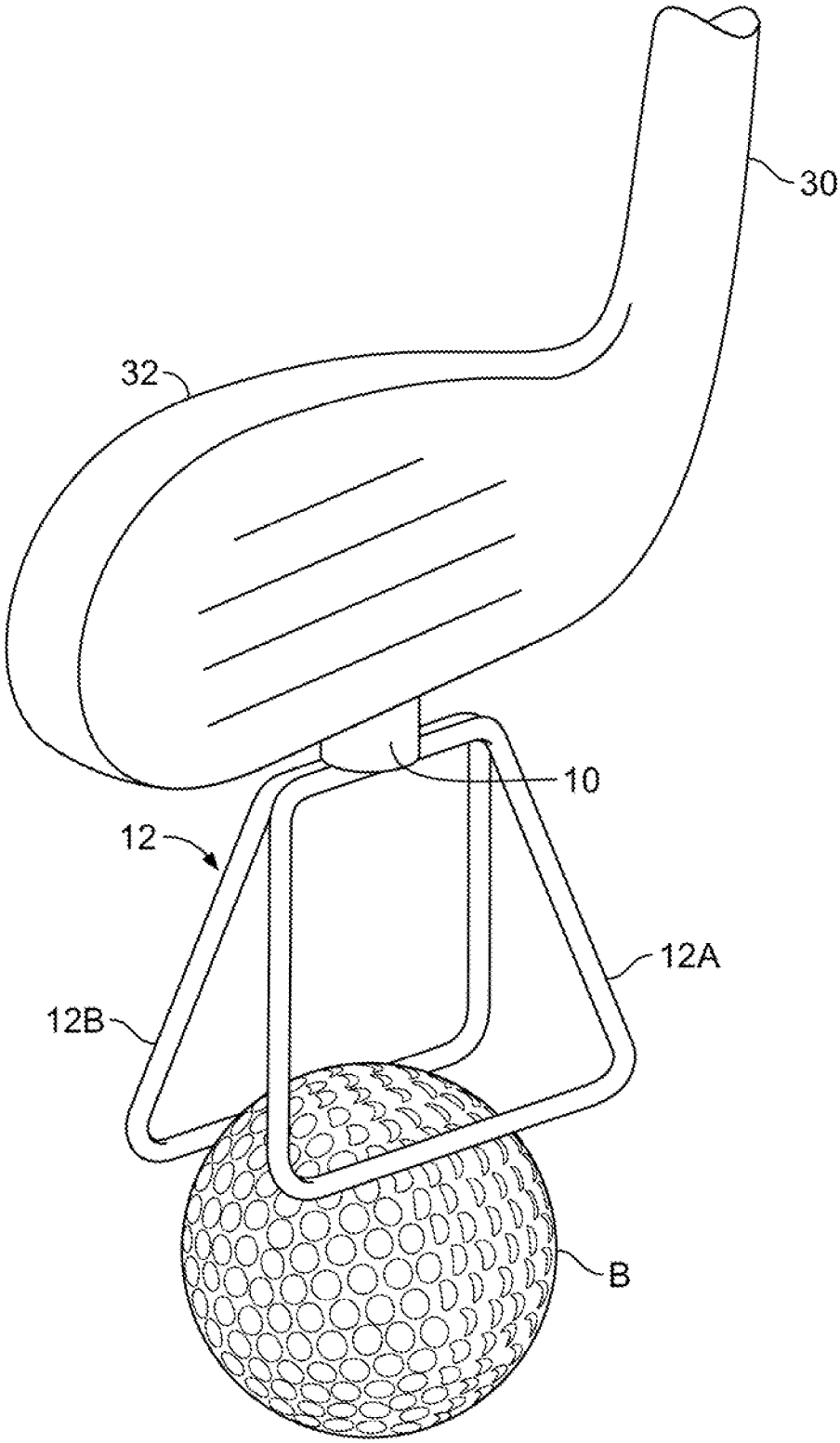
FIG. 4 is a perspective view of the retriever of FIG. 1 attached to the head of golf club and in the process of retrieving a golf ball.
Figure 5:
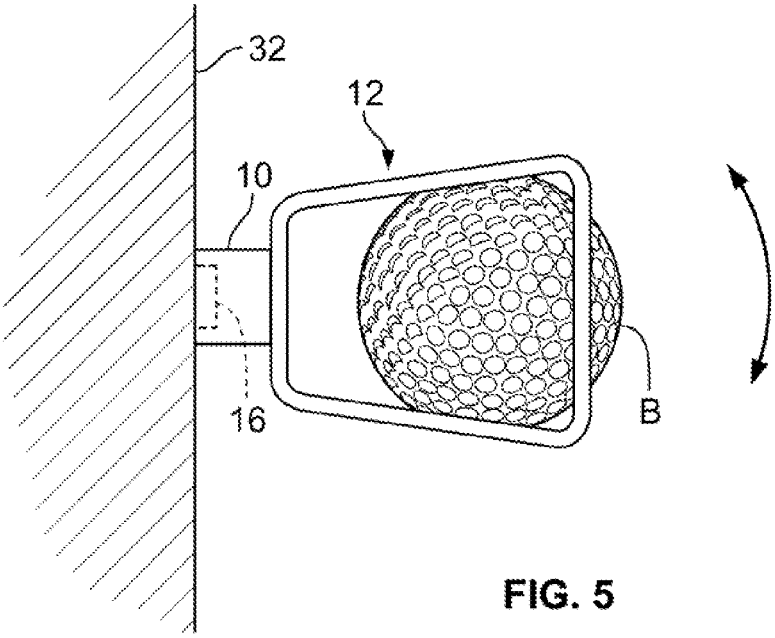
FIG. 5 is an elevational view of the retriever of FIG. 1 with its magnetic coupling attached to a vertical surface of a metal object.

To facilitate an understanding of the principles associated with the foregoing apparatus, the operation of the embodiment of FIGS. 1-2 will be briefly described in connection with the diagrams of FIGS. 4 and 5. The operation of the embodiment of FIG. 3 is essentially the same. In FIG. 4 golf club 30 has a head 32 arranged to act as an iron, although putters or other clubs that have a head formed with a ferromagnetic metal can be used as well.

The club will be initially inverted with the underside of head 32 facing up. The golfer will then place magnetic coupling 10 against the underside of head 32 so that magnet 16 will magnetically attach to head 32 and support gripper 12. The golfer can then bring head 32 down and position loops 12A and 12B of gripper 12 to partially straddle golf ball B, lying on the ground, as shown in FIG. 4. The golfer will then apply a downward force through golf club 30 and coupling 10, causing gripper 12 to deform so that loops 12A and 12B can encompass golf ball B as shown in FIG. 1. Next, the golfer will lift club 30 to bring golf ball B within reach.

Magnet 16 has a field strength sufficiently strong to hold magnetic coupling 10 on head 32 throughout this process. For example, FIG. 5 shows club head 32 (an unmagnetized metal object) being lifted and its underside forming a vertical surface. In this position, the weight and any acceleration forces of ball B and gripper 12 will apply a vertical force and angular moment at the joint between coupling 10 and club head 32. Head 32 is not modified to produce its own magnetic field to enhance the properties of magnetic coupling 10. Head 32 may simply be a non-magnetized material with ferromagnetic properties that allows magnet 16 to be strongly attracted and attached to head 32 (e.g., a metal object such as steel or other material with properties that allow magnetic attraction).

Once head 32 and gripper 12 are lifted, the golfer can then pull ball B out from between loops 12A and 12B of gripper 12. Around this time (before, after, or contemporaneously), gripper 12 will be manually grasped and pulled to remove magnetic coupling 10 from head 32.

The device of FIG. 1 (without golf ball B) can now be stored using clip 20. Specifically, clip 20 is shown in FIG. 1 attached to object 22. Object 22 may be an article of clothing worn by the golfer. For example, clip 20 may be attached to a shirt, a belt, pants etc. Alternatively, clip 20 may be attached to a golf bag (not shown) being used by the golfer. Consequently, gripper 12 will be readily available when needed and can be retrieved simply by releasing clip 20.

Figure 6:
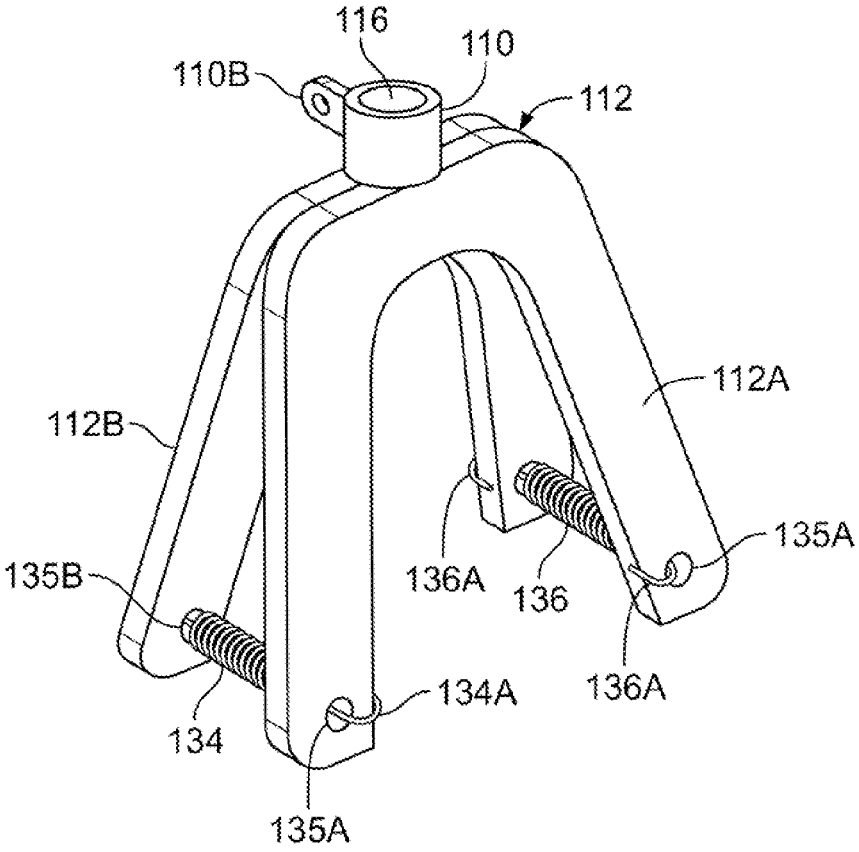
FIG. 6 is a perspective view of a golf ball retriever that is an alternate to that of FIGS. 1 and 3.

Referring to FIG. 6, the illustrated ball retriever is an alternate to that of FIG. 1. Components corresponding to those of FIG. 1 have the same reference numeral but increased by 100. Magnetic coupling 110 is a cylindrical collar holding a magnet 116 with a field strength similar to that previously described. Collar 110 also has an eyelet 110B for tethering a clip as described before.

Gripper 112 has a pair of U-shaped elements 112A and 112B each lying on planes that diverge relative to coupling 110. The proximal edges of elements 112A and 112B each have semicylindrical stubs designed to fit inside collar 110 in a manner similar to that shown in FIG. 2. Alternatively, elements 112A and 112B may have proximally projecting pads that can be fastened together by a screw or other means.

The right and left tips of element 112A each have a hole 135A. The right and left tips of element 112B each have a hole 135B. Extension spring 134 has on either end, hooks 134A that hook into holes 135A and 135B on the left tips of elements 112A and 112B. Likewise, extension spring 136 has on either end, hooks 136A that hook into holes 135A and 135B on the right tips of elements 112A and 112B.

The device of FIG. 6 can be used in a manner similar to that previously described for the device of FIG. 1. Specifically, with magnetic coupling 110 attached to the underside of the head of the golf club, elements 112A and 112B can be pressed down to deform slightly, stretch springs 134 and 136, and encompass a golf ball. In particular, the golf ball will rest upon springs 134 and 136 and cause them to bow slightly outward.

Figure 7:
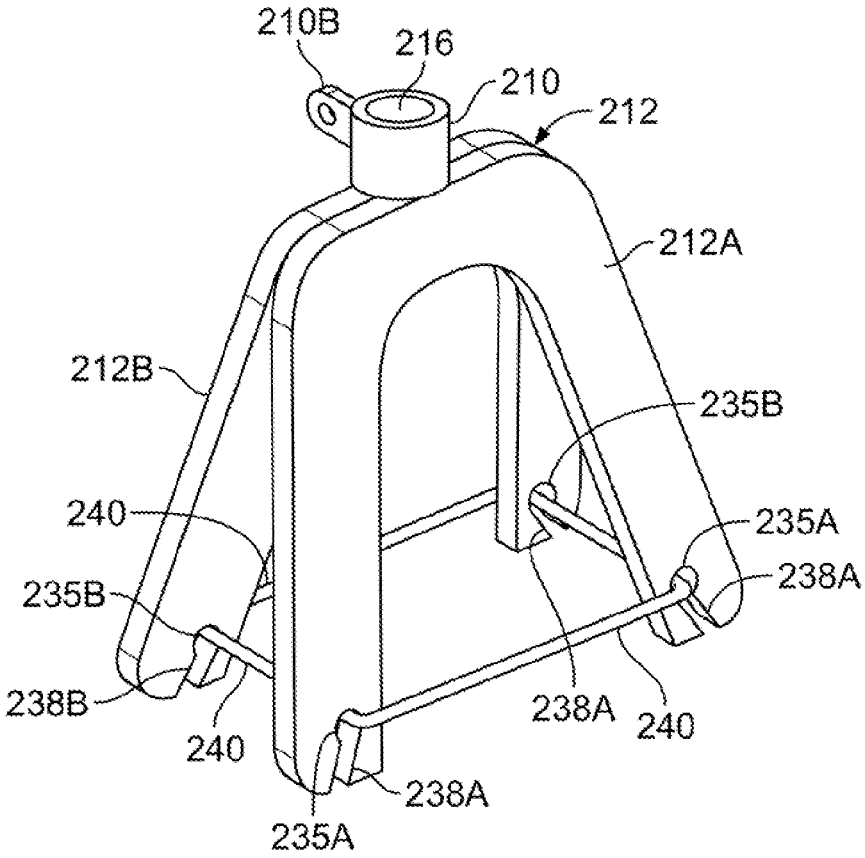
FIG. 7 is a perspective view of a golf ball retriever that is an alternate to that of FIGS. 1, 3 and 6.

Referring to FIG. 7, the illustrated ball retriever is an alternate to that of FIG. 6. Components corresponding to those of FIG. 6 have the same reference numeral but increased by 100. Magnetic coupling 210 is a cylindrical collar holding a magnet 216 with a field strength similar to that previously described. Collar 210 also has an eyelet 210B for tethering a clip as shown before. Gripper 212 has a pair of U-shaped elements 212A and 212B each lying on planes that diverge relative to coupling 210. The proximal edges of elements 212A and 212B can be connected to collar 110 in the manner described before in connection with FIG. 6.

The right and left tips of element 212A each have a keyhole-type of aperture with a hole 235A opening into slot 238A. The right and left tips of element 212B each have a keyhole-type of aperture with a hole 235B opening into slot 238B. Elastic cord 240 is strung through the four holes 235A and 235B to act as a stretchable element tending to pull elements 212A and 212B together.

The device of FIG. 7 can be used in a manner similar to that previously described for the device of FIG. 6. Specifically, with magnetic coupling 210 attached to the underside of the head of the golf club, elements 212A and 212B can be pressed down to deform slightly, stretch cord 240, and encompass a golf ball. In particular, the golf ball will rest upon cord 240 and cause it to bow slightly outward.

Figure 8:
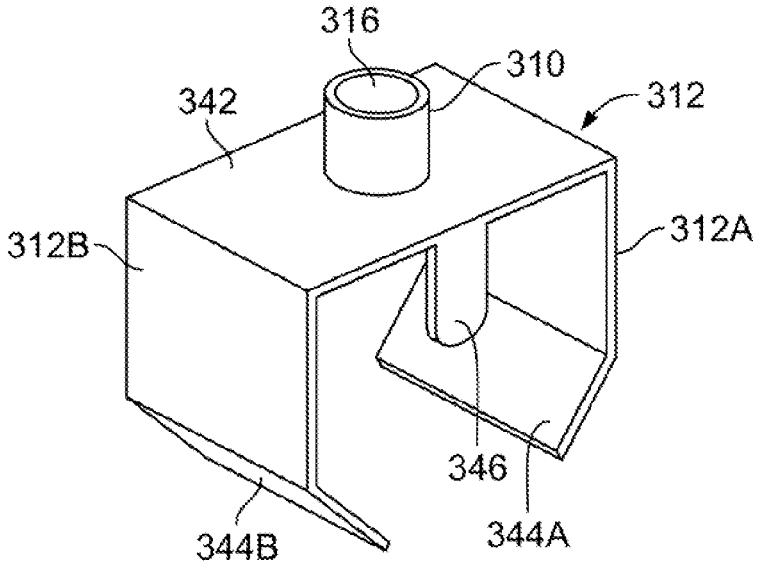
FIG. 8 is a perspective view of a golf ball retriever that is an alternate to that shown in the foregoing Figures.

Referring to FIG. 8, the illustrated ball retriever is an alternate to that of FIG. 1. Components corresponding to those of FIG. 1 have the same reference numeral but increased by 300. Gripper 312 has a transverse plate 342 that is integral with an opposing pair of parallel plates 312A and 312B. The distal ends of plates 312A and 312B terminate in in-turned lips 344A and 344B, respectively. A pair of stops 346 (only one visible in this view) depend from opposite edges of plate 342 and intersect a plane parallel to and equidistant from plates 312A and 312B.

Magnetic coupling 310 is a cylindrical collar attached to plate 342. Collar 310 holds a magnet 316 with a field strength similar to that previously described.

The device of FIG. 8 can be used in a manner similar to that previously described for the device of FIG. 1. Specifically, with magnetic coupling 310 attached to the underside of the head of the golf club, lips 344A and 344B can be pressed down to spread plates 312A and 312B, so that they encompass a golf ball. In particular, the golf ball will rest upon lips 344A and 344B. Stops 346 will prevent the ball from escaping in a direction parallel to plates 312A and 312B.

Figure 9:
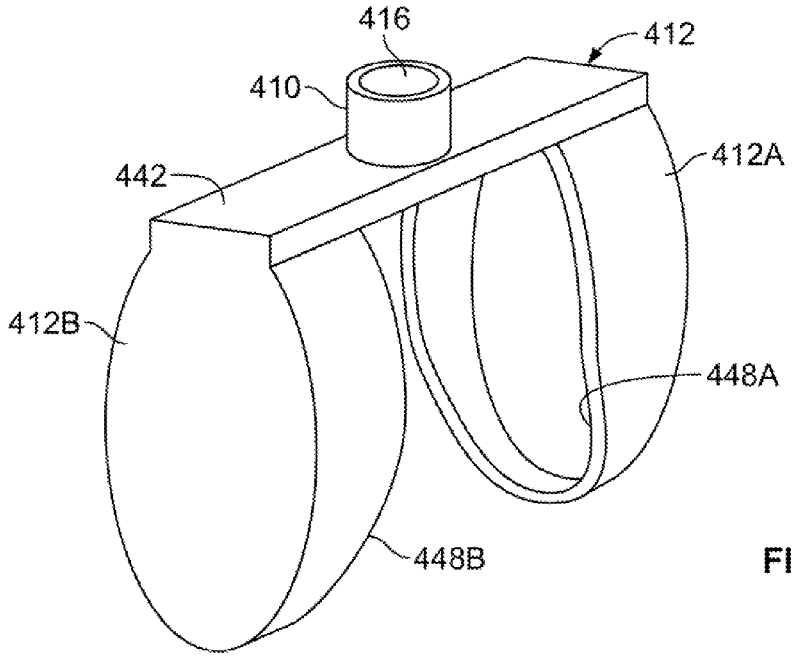
FIG. 9 is a perspective view of a golf ball retriever that is an alternate to that shown in the foregoing Figures.

Referring to FIG. 9, the illustrated ball retriever is an alternate to that of FIG. 8. Components corresponding to those of FIG. 8 have the same reference numeral but increased by 100. Gripper 412 has a transverse plate 442 that is integral with an opposing pair of shells 412A and 412B. Shells 412A and 412B are cup shaped and each has a rim that is distally depressed to form bevelled distal lips 448A and 448B.

Magnetic coupling 410 is a cylindrical collar attached to plate 442. Collar 410 holds a magnet 416 with a field strength similar to that previously described.

The device of FIG. 9 can be used in a manner similar to that previously described for the device of FIG. 8. Specifically, with magnetic coupling 410 attached to the underside of the head of the golf club, bevelled lips 448A and 448B can be pressed down to spread shells 412A and 412B, so that they encompass a golf ball.

Figure 10:
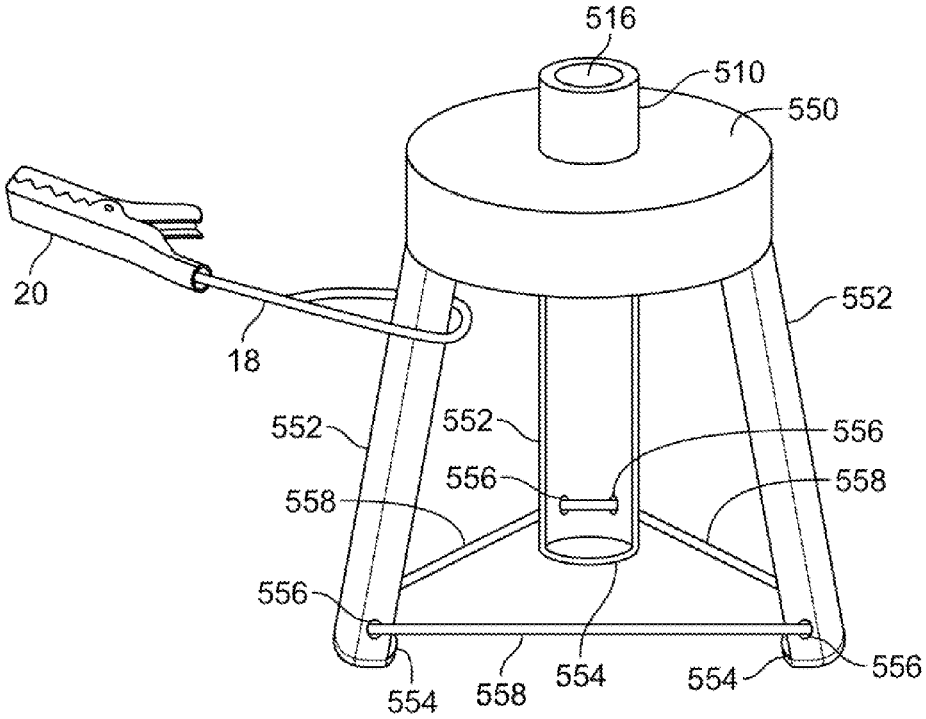
FIG. 10 is a perspective view of a golf ball retriever that is an alternate to that shown in the foregoing Figures.

Referring to FIG. 10, magnetic coupling 510 is a cylindrical collar attached to cup-shaped member of 550. Magnetic coupling 510 is similar to that described in FIG. 1 and holds a magnet 516 having a field strength similar to that previously described. Attached to the rim of member 550 are a trio of equiangularly spaced legs 552. Legs 552 diverge slightly and have a gutter-like shape, the concave side facing inwardly. The tips of legs 552 each have a distal, inwardly directed lip 554.

Each of the legs 552 have a pair of distal holes 556. An elastic cord 558 is strung through the holes 556 of the trio of legs 552 to act as a stretchable element. Previously mentioned cord 18 (FIG. 1) is looped around one of the legs 552 to tether previously mentioned clip 20. Clip 20 will be used as before to secure and hold the illustrated device.

The device of FIG. 10 can be used in a manner similar to that previously described for the device of FIG. 7. Specifically, with magnetic coupling 510 attached to the underside of the head of the golf club, lips 554 can be pressed down upon a golf ball (not shown) to spread legs 552, stretch cord 558, and encompass a golf ball. In particular, the golf ball will rest upon lips 554 and cord 558, causing the cord to bow slightly outward.

Figure 11:
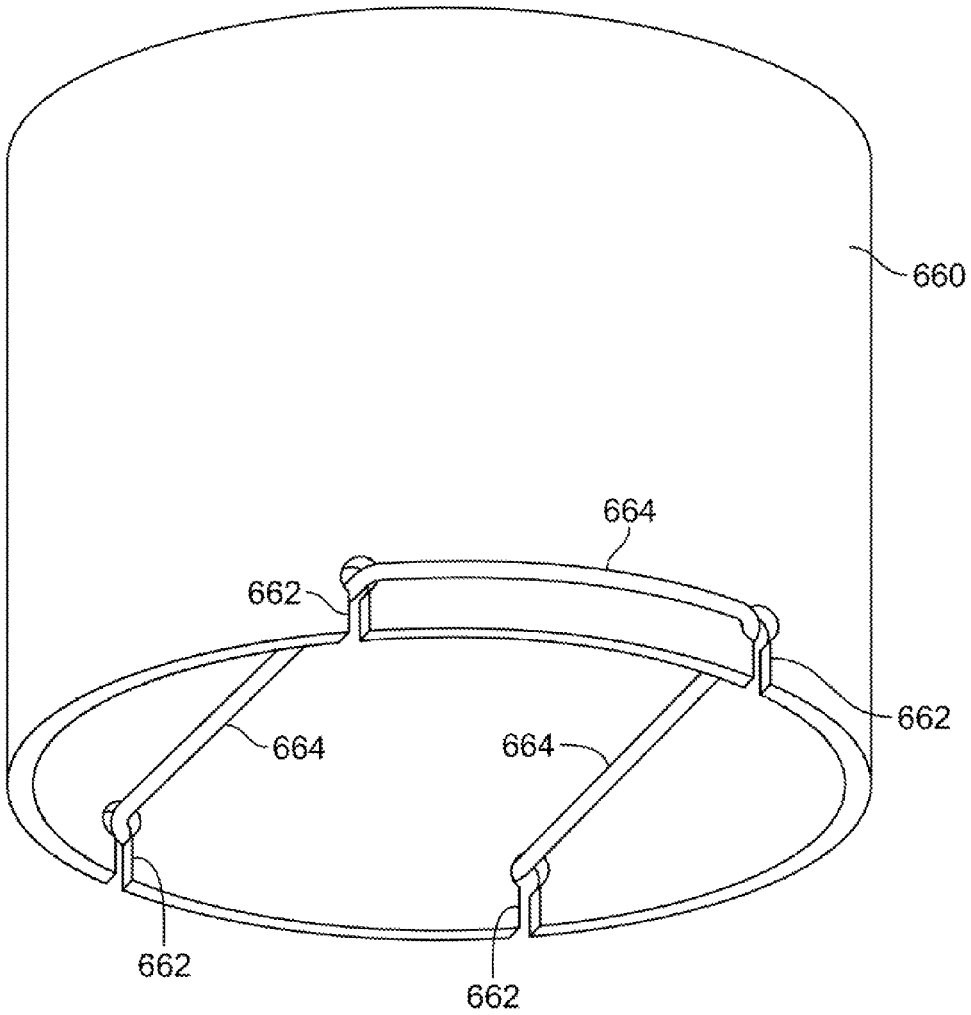
FIG. 11 is a perspective view of a golf ball retriever that is an alternate to that shown in the foregoing Figures.

Referring to FIG. 11, the illustrated golf ball retriever is in the form of a cup 660 having an inside diameter large enough to encompass a golf ball. The proximal end of cup 660 is closed and has attached on it a magnetic coupling (hidden from view), similar to coupling 10 of FIG. 1. The open end of cup 660 has on its rim four keyhole-shaped notches 662. An elastic cord 664 is strung in a closed loop through notches 662 to act as a stretchable element.

The device of FIG. 11 can be used in a manner similar to that previously described for the device of FIG. 10. Specifically, after magnetically attaching cup 660 to the underside of the head of the golf club, cord 664 can be pressed down upon a golf ball (not shown) to stretch cord 664, which will then encompass and hold a golf ball. In particular, the golf ball will rest upon cord 664, causing the cord to bow slightly.

Obviously, many modifications and variations of the present invention are possible in light of the above teachings. It is therefore to be understood that within the scope of the appended claims, the invention may be practiced otherwise than as specifically described.

The invention claimed is:

1. A golf ball retriever comprising:

a gripper for holding a golf ball; and a coupling attached to said gripper, said coupling having a cavity containing a magnet, said magnet having a field strength adequate to hold onto a vertical surface of an unmagnetized metal object with said gripper holding a golf ball therein, said coupling comprising a collar encircling said magnet, said gripper having a stem held in said collar adjacent to said magnet.

2. A golf ball retriever according to claim 1 wherein said collar is metallic.

3. A golf ball retriever according to claim 1 wherein said stem comprises:

a complementary pair of semicylindrical stubs.

4. A golf ball retriever according to claim 3 wherein said gripper comprises:

a pair of trapezoidal loops, said pair of stubs being separately attached to a different corresponding one of said trapezoidal loops.

5. A golf ball retriever according to claim 1 wherein said collar comprises:

an eyelet; and a tether secured in said eyelet.

6. A golf ball retriever according to claim 5 wherein said collar comprises:

a clip attached to said tether and having jaws for clipping onto an object.

7. A golf ball retriever according to claim 1 wherein said gripper comprises:

an opposing pair of shells yieldingly biased together to engage and hold a golf ball, each of said shells having a beveled distal lip.

8. A golf ball retriever according to claim 1 wherein said gripper comprises:

a trio of legs yieldingly biased together to engage and hold a golf ball, each of said legs having a distal inwardly directed lip.

9. A golf ball retriever according to claim 1 wherein said gripper comprises:

a trio of legs; and a stretchable element distally suspended on said trio of legs and arranged to engage and hold a golf ball.

10. A golf ball retriever according to claim 1 wherein said gripper comprises:

a cup having a rim; and a stretchable element suspended on said rim and arranged to releasably engage and hold a golf ball.

11. A golf ball retriever according to claim 1 wherein said gripper comprises:

a pair of U-shaped elements; and at least one stretchable element suspended distally on said pair of elements to releasably engage and hold a golf ball.

12. A golf ball retriever according to claim 1 wherein said gripper comprises:

an opposing pair of plates, each with an in-turned lip, said plates being yieldingly biased together to engage and hold a golf ball; and a pair of stops lying on a plane between said pair of plates for keeping the golf ball from sliding out from between said pair of plates.

13. A golf ball retriever comprising:

a gripper for holding a golf ball, said gripper including a pair of trapezoidal loops, each of said loops having one of a complementary pair of semicylindrical stubs; and a coupling attached to said gripper, said coupling having a cavity containing a magnet, said magnet having a field strength adequate to hold onto a vertical surface of an unmagnetized metal object with said gripper holding a golf ball therein, said coupling comprising:

a collar encircling said magnet, said semicylindrical stubs being mounted in said collar adjacent to said magnet;

an eyelet projecting from said collar;

a tether secured in said eyelet; and a clip attached to said tether and having jaws for clipping onto an object.

* * * * *